US008528123B2

(12) United States Patent
Hashem et al.

(10) Patent No.: US 8,528,123 B2
(45) Date of Patent: Sep. 10, 2013

(54) EXTERIOR RIM WASH BOWL

(75) Inventors: Michael Hashem, Wooster, OH (US); Gerald James ST.Louis, Ingleside (CA); Stanley Andrews, Green Valley (CA)

(73) Assignee: Dometic Corporation, Big Prairie, OH (US)

( * ) Notice: Subject to any disclaimer, the term of this patent is extended or adjusted under 35 U.S.C. 154(b) by 950 days.

(21) Appl. No.: 12/277,719

(22) Filed: Nov. 25, 2008

(65) Prior Publication Data

US 2010/0125945 A1 May 27, 2010

(51) Int. Cl.
*E03D 11/00* (2006.01)

(52) U.S. Cl.
USPC ..... 4/420; 4/901; 4/300; 4/429

(58) Field of Classification Search
USPC ..... 4/420, 901, DIG. 15, 349, 300, 429
See application file for complete search history.

(56) References Cited

U.S. PATENT DOCUMENTS 1,555,302 A * 9/1925 McLanahan ..... 4/300
4,006,497 A * 2/1977 Mollerstedt ..... 4/420
4,155,129 A * 5/1979 Russell ..... 4/429
4,228,554 A 10/1980 Tumminaro
4,928,328 A * 5/1990 Davis ..... 4/420
5,184,355 A 2/1993 Taguchi et al.
5,909,968 A 6/1999 Olin et al.
6,145,138 A 11/2000 Nakamura et al.
6,457,188 B1 10/2002 Lindberg
7,263,758 B2 9/2007 Davies et al.
2007/0124913 A1 6/2007 Davies et al.

* cited by examiner

*Primary Examiner* — Gregory Huson
*Assistant Examiner* — Lauren Heitzer
(74) *Attorney, Agent, or Firm* — Pearne & Gordon LLP

(57) ABSTRACT

A one-piece bowl including an open top, a bottom opening, a rim portion, an interior space and a plurality of cavities is provided. The rim portion substantially surrounds the bowl near the open top, and an inner channel is formed along and within the rim portion. The interior space is substantially defined by an interior surface, the open top and the bottom opening. The plurality of cavities extends from the inner channel to the interior space. The inner channel and the cavities are configured to pass fluid from an outer fluid source to the interior space. A mold assembly and a method for forming a one-piece greenware piece for the bowl are also provided. The mold assembly includes a top mold component and a bottom mold component that are configured to mate and thereby form a reservoir substantially defining the bowl.

15 Claims, 5 Drawing Sheets

EXTERIOR RIM WASH BOWL

FIELD OF THE INVENTION

The present invention relates generally to bowls about which fluid flows through and, more particularly, to bowls molded to include cavities and inner channels to allow such flow of fluid.

BACKGROUND OF THE INVENTION

Molds are commonly used to form ceramic wares of various shapes or to produce such wares in mass or small scale. One method of utilizing molds is called slipcasting. Slipcasting involves pouring slip, which is a mixture of clay and water, into a reservoir in the mold that is made of highly absorbent material such as plaster. The mold absorbs water from the outer parts of the slip such that the slip hardens from parts closest to the interior surface of the mold toward the interior of the slip. When it is necessary for the ceramic ware to be configured with cavities, the slip is hardened for a known amount of time and the remaining, non-hardened slip is drained out of the mold through holes. After the hardened slip is removed from the mold, it is allowed to dry becoming a greenware piece that is then fired with or without glaze to become a finished product.

Although slipcasting can be used to produce objects of complex shapes, the complexity of the shape may require the final product to be divided into multiple portions so that each portion is cast separately and secured together such as by gluing prior to firing. As the number of separately cast portions increases, the number of mold components needed to produce the final product increases correspondingly resulting in a more complicated molding manufacturing process. Conventional toilet bowls typically require a plurality of portions to be separately molded and secured together. Thus, there is a need for a bowl with an alternative design that will reduce the number of mold components and simplify the casting process.

BRIEF SUMMARY OF THE INVENTION

To achieve the foregoing and other aspects and in accordance with the present invention, a one-piece bowl that includes an interior surface, a rim portion, an inner channel and a plurality of cavities is provided. The interior surface defines an open top, a bottom opening, and an interior space. The rim portion substantially surrounds the bowl near the open top, and an inner channel is formed along and within the rim portion. The plurality of cavities extends from the inner channel to the interior space. The inner channel and the cavities are configured to operably pass fluid originating from an outer fluid source to the interior space.

In accordance with another aspect, the interior space is widest at the open top and narrowest at the bottom opening.

In accordance with yet another aspect, a first horizontal cross section of the interior space at a given height is not larger in area than a second horizontal cross section at a more elevated height.

In accordance with yet another aspect, the interior space is configured to gradually taper from the open top to the bottom opening.

In accordance with yet another aspect, the rim portion is configured on the bowl to project away from the interior space.

In accordance with yet another aspect, the interior surface is smooth and free of substantial protrusions.

In accordance with yet another aspect, the cavities are formed in a substantially radial direction.

In accordance with yet another aspect, the plurality of cavities is oriented at a slight downward angle from the inner channel to the interior space.

In accordance with yet another aspect, an inclination of the interior surface on which the cavities are formed is substantially closer to vertical than horizontal.

In accordance with yet another aspect, the bowl includes a fluid supply hole for introducing fluid into the inner channel.

In accordance with yet another aspect, the bowl includes a base allowing the bowl to stand on its own.

In accordance with yet another aspect, the bowl substantially constitutes a receptacle portion of a toilet system, and the inner channel and the bottom opening are operably connected with a flushing system of the toilet system.

In accordance with yet another aspect, a top mold component and a bottom mold component by which a greenware piece of the bowl is made are configured to mate and thereby form a reservoir configured to substantially define the bowl. The bottom opening is formed by a first protrusion of the top mold component and a second protrusion of a bottom mold component that contact when the top mold component and the bottom mold component mate.

In accordance with yet another aspect, a mold assembly for forming a one-piece greenware piece for a bowl is provided. The mold assembly includes a top mold component and a bottom mold component. The top mold component and the bottom mold component are configured to mate and thereby form a reservoir configured to substantially define the bowl. The bowl is configured to include an interior surface defining an open top, a bottom opening, a rim portion and an interior space. The rim portion is configured to substantially surround the bowl near the open top.

In accordance with yet another aspect, the bowl substantially constitutes a receptacle portion of a toilet system, and the inner channel and the bottom opening are operably connected with a flushing system of the toilet system.

In accordance with yet another aspect, a first protrusion of the top mold component and a second protrusion of a bottom mold component are configured to contact when the top mold component and the bottom mold component mate so as to create the bottom opening.

In accordance with yet another aspect, the mold assembly further includes at least one intermediate mold component. The intermediate mold component includes an upper portion and a lower portion. The upper portion is similar in shape to the bottom mold component. The lower portion is similar in shape to the top mold component. The at least one intermediate mold component is configured to be placed between the top mold component and the bottom mold component to form a plurality of the reservoirs so that a plurality of the one-piece greenware pieces can be formed simultaneously.

In accordance with yet another aspect, a method for forming a one-piece greenware piece of a bowl is provided. The method comprises the steps of mating a top mold component and a bottom mold component, the top mold component and the bottom mold component thereby forming a reservoir configured to substantially define the bowl, the bowl configured to include an interior surface defining an open top, a bottom opening, a rim portion and an interior space, the rim portion configured to substantially surround the bowl near the open top. The method further comprises filling the reservoir with slip. The method further comprises forming an inner channel along and within the rim portion by removing unhardened slip from the reservoir after letting the slip harden for a predetermined amount of time. The method further comprises removing the top and bottom mold components and letting the slip dry to obtain a greenware piece substantially similar in shape to the bowl. The method further comprises forming a plurality of cavities on the interior surface, the plurality of cavities extending from the inner channel to the interior space.

In accordance with yet another aspect, a first horizontal cross section of the interior space at a given height is not larger in area than a second horizontal cross section at a more elevated height.

In accordance with yet another aspect, the method further includes the step of forming the bottom opening using a first protrusion of the top mold component and a second protrusion of a bottom mold component that contact when the top mold component and the bottom mold component mate.

BRIEF DESCRIPTION OF THE DRAWINGS

The foregoing and other aspects of the present invention will become apparent to those skilled in the art to which the present invention relates upon reading the following description with reference to the accompanying drawings, in which.

DESCRIPTION OF EXAMPLE EMBODIMENTS

Figure 1A:
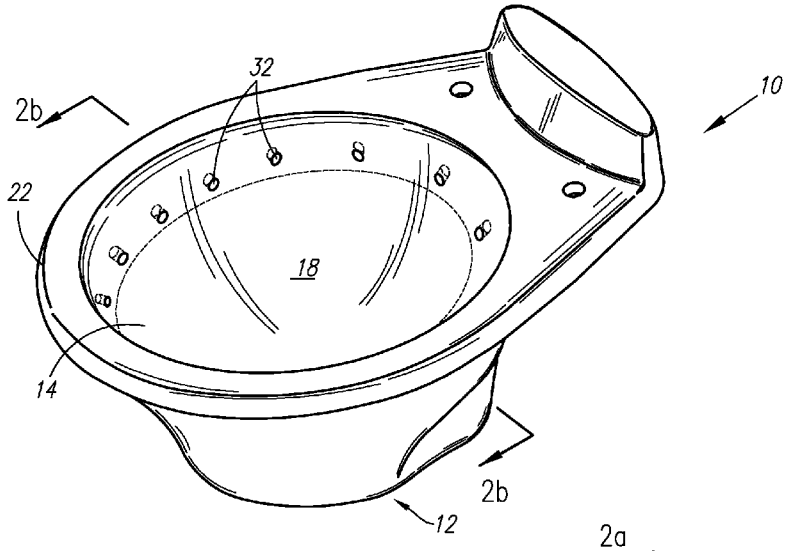
FIG. 1A is a perspective view of an example embodiment of a bowl according to the present invention.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices.

Figure 1B:
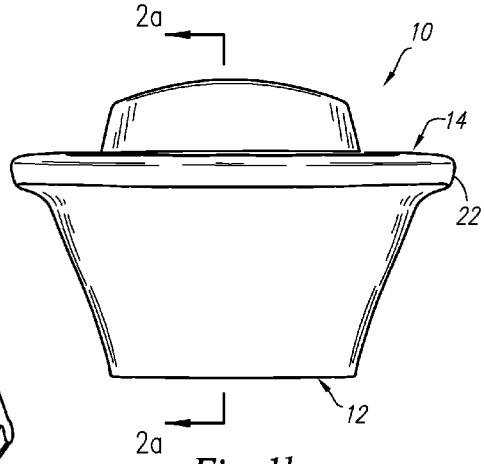
FIG. 1B is a front view of the bowl.
Figure 1C:
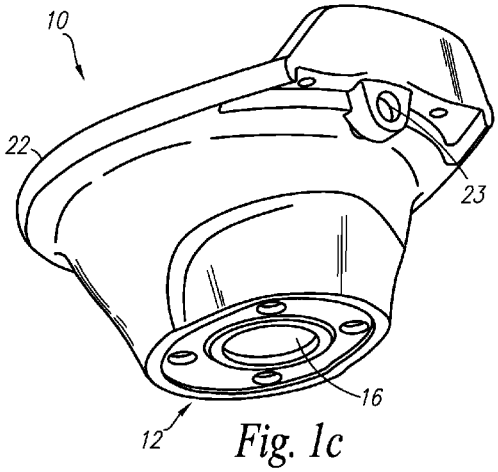
FIG. 1C is a perspective rear view of the bowl.

Turning to the shown example of FIGS. 1A-1C, an embodiment of a bowl 10 according to the present invention is illustrated. This embodiment of the bowl 10 is configured to constitute a receptacle portion of a toilet system provided to receive urination and defecation. As such, the bowl 10 may be configured with a means to accommodate a toilet seat and cover (not shown) in order to allow a person to sit on top of the bowl 10. However, the invention need not include such means because it is not limited to toilet systems and may be implemented on any apparatus in which a flow of fluid about a bowl or a vessel-shaped structure is operatively controlled.

Figure 2A:
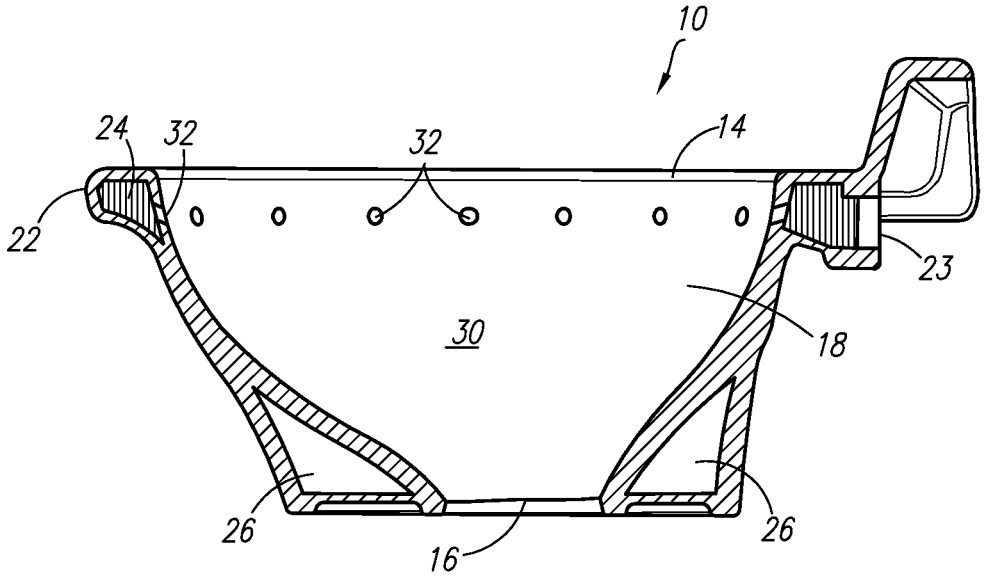
FIG. 2A is a cross-sectional view of the bowl along its length.
Figure 2B:
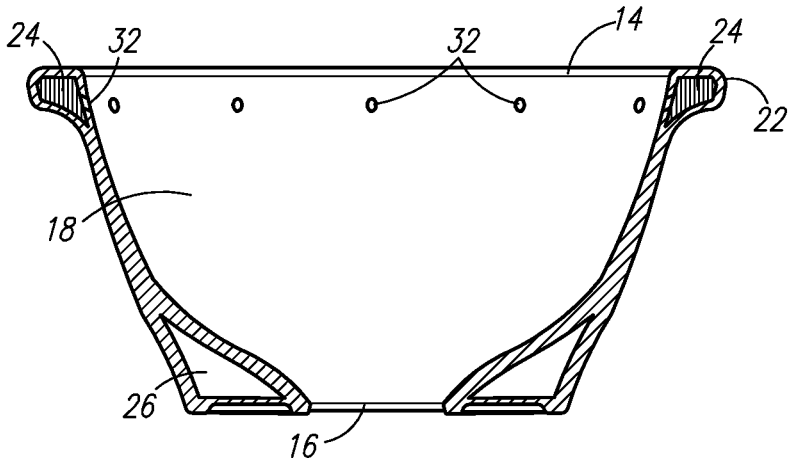
FIG. 2B is a cross-sectional view of the bowl along its width.
Figure 6:
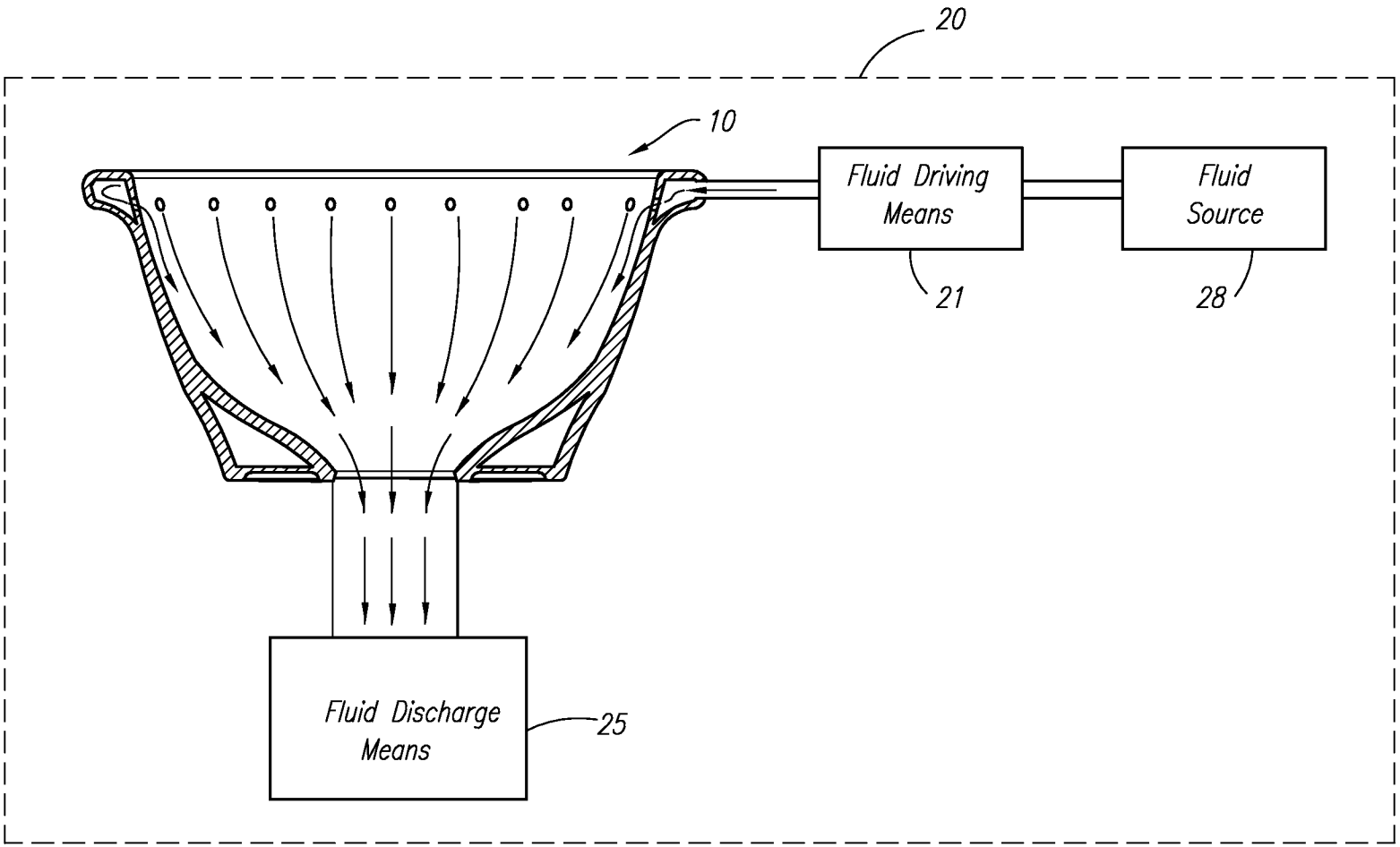
FIG. 6 is a schematic view of the bowl in operative connection with a fluid flow control system.

The bowl 10, which is molded to be in one-piece or integral, may have a base 12 so that the bowl 10 can stand on its own on a surface or the bowl 10 may be supported by other means. Moreover, although this embodiment shows an oval top 14, the top 14 of the bowl 10 may have other geometric configurations such as a circle or a polygon. The top 14 of the bowl 10 is open to allow various types of matters, such as feces in case of this embodiment, to be received and washed away from the bowl 10 by a fluid flow control system 20 (FIG. 6) provided with a fluid driving means 21 that creates the flow of fluid. One example of the fluid flow control system 20 is a toilet system, of which the bowl 10 may be a part, and a drainage mechanism related thereto. The bowl 10 is in operative connection with the fluid flow control system 20, such as a flushing, drainage or plumbing system, that allows fluid to flow into a fluid supply hole 23 (FIG. 1C) and out of the bowl 10 through an opening 16, provided at a bottom of the bowl 10, to a fluid discharge area 25 (FIG. 6). As shown in FIGS. 2A-2B, the various matters, including the fluid, that are received by the bowl 10 can be momentarily stored in an interior space 18 of the bowl 10. Despite the opening 16 at the bottom of the bowl 10, the various matters may be maintained inside the bowl 10 near or below the bottom opening 16 until these matters are flushed or drained through the operation of the fluid flow control system 20.

The bowl 10 is provided with a rim portion 22 that includes an inner channel 24 within which fluid can flow. The inner channel 24 and foot drain cast cavities 26 of the bowl 10 are formed during a molding process that will be described later. The rim portion 22 may be formed on the bowl 10 to substantially surround the bowl 10 near the open top 14 so as to extend substantially along an outer perimeter of the bowl 10. The rim portion 22 is near the open top 14 in that the rim portion 22 may be formed at an uppermost part of the bowl 10 or slightly underneath. The inner channel 24 also substantially extends where the rim portion 22 is provided and be axially arranged inside the rim portion 22. But the extent or range of the two need not equal and, for example, certain parts of the rim portion 22 may not include the inner channel 24. In this embodiment, as shown in FIGS. 1C, 2A and 6, fluid that originates from an outer fluid source 28 is introduced into the inner channel 24 by the fluid driving means 21 through the fluid supply hole 23 (FIG. 1C) that leads to the inner channel 24. The rim portion 22 does not project inwardly into the interior space 18 of the bowl 10 so as to create a protrusion on an interior surface 30 of the bowl 10. The rim portion 22 may or may not project outwardly with respect to an exterior surface of the bowl 10.

The outer fluid source 28 may be an adjacent cistern in case of a household toilet system or a remotely-located storage tank in case of other applications that contain fluids such as water. The fluid driving means 21 may be an arrangement of fluid at an elevation higher than the bowl 10 so that fluid can be driven by gravity when a valve is opened or a pump that puts the fluid under pressure locally or remotely before providing it to the bowl 10. The fluid discharge means 25 may be a siphon tube driving the emptying of liquid from the bowl 10, or piping that simply drains and directs fluid by gravity to a storage area such as a septic or sewer tank. In case of a flushing mechanism for a conventional toilet, emptying of water from the cistern would trigger a flow large enough to fill a siphon tube further downstream and the bowl 10 would then be drained by siphon action until the water in the bowl 10 is lowered to a predetermined level. Thus, in a toilet, a cistern would operate as the fluid driving means 21 while a siphon tube operates as the fluid discharge means 25. A certain amount of water will be trapped at the bottom opening 16 if the bowl 10 is used as part of a toilet system.

The rim portion 22 need not be formed near the open top 14 or the highest part of the bowl 10 and, for example, could be formed around the middle of the bowl 10 or lower. But if the rim portion 22 and subsequently the cavities 32 are located higher on the bowl 10, it is likely that more of the interior surface 30 will be covered by fluid flow when fluid flow occurs.

The interior surface 30 of the bowl 10 includes a plurality of cavities 32 which extend from the inner channel 24 to the interior surface 30 and allow fluid communication between the inner channel 24 and the interior space 18. The cavities 32 may be formed at substantially the same height on the interior surface 30 and may be evenly scattered along the periphery of the interior space 18 so that the fluid exiting the cavities 32 can flow and cover all or a significant part of the interior surface 30. The cavities 32 may be formed in various ways to achieve a variety of effects in the introduction of fluid into the interior space 18 and, for example, may be oriented in radial directions so that the cavities 32 are formed horizontally. For the cavities 32 to be oriented in a substantially radial manner, the inclination of the interior surface 30 on which the cavities 32 are formed will have to be closer to vertical rather than horizontal. In this embodiment, the cavities 32 are oriented at a slight downward angle as they proceed from the inner channel 24 to the interior space 18. However, the angle at which the cavities 32 are formed is not limited in range and may be completely horizontal (i.e., 0° about a horizontal surface), tilted toward the bottom opening 16 by 5° from horizontal, 10° from horizontal or more, or may even be tilted away from the bottom opening 16, e.g., −5° from horizontal. There may be a combination of angles in a single bowl 10 depending on the geometry of the interior surface 30. If the interior surface 30 is steeper near a cavity 32, a larger incline toward the bottom opening 16 may result in better contact by water flow with the interior surface 30 as water flow exits the cavity 32.

The interior space 18 of the bowl 10 is substantially defined by an interior surface 30 of the bowl 10, the open top 14 and the bottom opening 16. The interior space 18 substantially and vertically extends from the open top 14 to the bottom opening 16. The interior surface 30 need not extend fully from an uppermost part to a bottommost part of the bowl 10 because the uppermost part and the bottommost part of the bowl 10 need not coincide with the open top 14 and bottom opening 16 respectively. The interior space 18 may be smooth and free of substantial protrusions for purposes of effect as to fluid flow or aesthetics. The interior space 18 is configured such that introduction of fluid in the bowl 10 removes substantially all matter from the interior surface 30 and channels substantially all matter in the interior space 18 toward the bottom opening 16. The interior space 18 may be configured such that the interior space 18 is at its widest at the open top 14 and at its narrowest at the bottom opening 16. The interior space 18 may also gradually narrow or taper from the open top 14 to the bottom opening 16. In this configuration, a horizontal cross section of the interior space 18 at a given height of the bowl will be larger in area than a horizontal cross section at a less elevated height.

The interior space 18 may also be configured such a horizontal cross section of the interior space 18 at a given height of the bowl 10 is not wider or larger in area than a horizontal cross section of the interior space 18 at a more elevated height on the bowl 10. This configuration encompasses an interior space 18 that has a portion whose horizontal cross section maintains an equal dimension or area vertically or does not narrow.

Although the common method of "slip casting" is used to describe how the shape of the bowl 10 can be formed, the benefits that the present invention can offer are not limited to slip casting and the problems that the present invention can solve do not arise only in slip casting. In other words, the present invention contemplates, and can be applied to, variations of slip casting and any and all methods of using liquid clay to form a product. Accordingly, the present invention has applicability to other methods such as drain casting, solid casting, vacuum casting, pressure casting, centrifugal casting, fugitive-mold casting, or gel casting.

Figure 3:
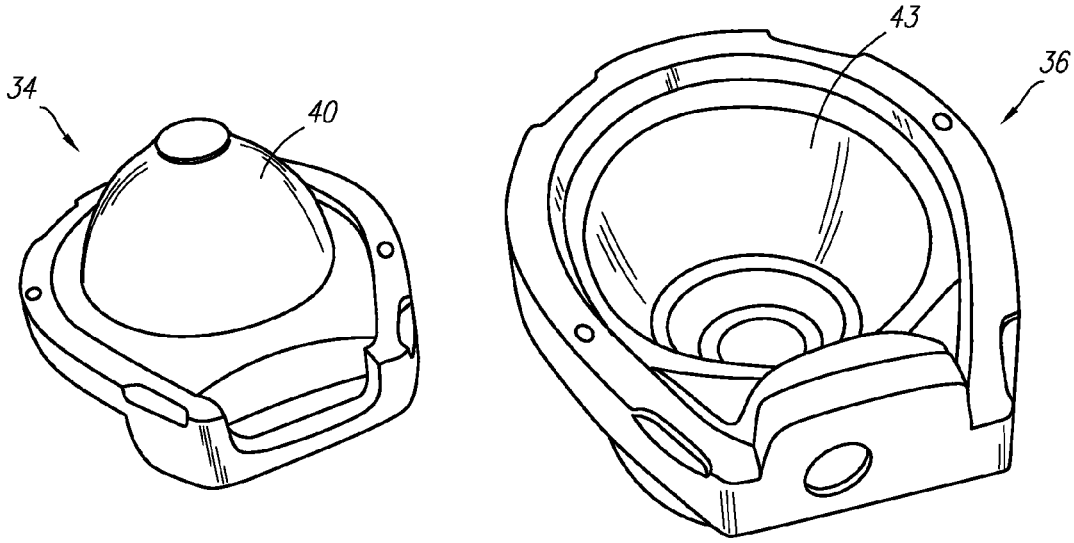
FIG. 3 is a view of an example embodiment of a top mold component and a bottom mold component for casting the mold.
Figure 4:
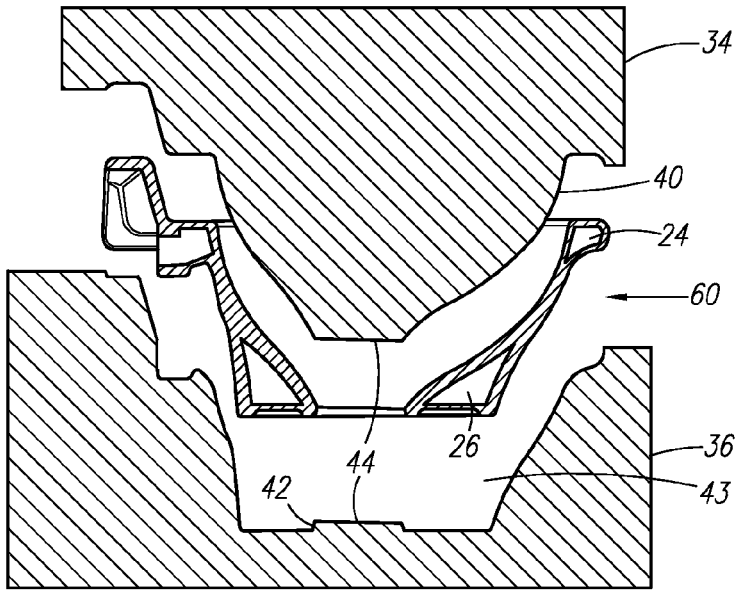
FIG. 4 is a cross-sectional view of a molded piece for the bowl upon removal from the top and bottom mold components.

As shown in FIGS. 3-4, the geometry and configuration of the bowl 10 are such that only a top mold component 34 and a bottom mold component 36 are required to substantially shape the bowl 10. The mold components 34, 36 may be made of plaster of Paris. The mold components 34, 36 may include other materials, such as porous resin in case of pressure casting which is less susceptible to pressure than plaster. The slip may be made from a mixture of clay and water. The top and bottom mold components 34, 36 are shaped such that a reservoir 38 substantially similar in shape to the bowl 10 is created when the two mold components 34, 36 mate or are put together. Thus, the shape of the bowl will be substantially defined by the reservoir. Thereafter, the reservoir 38 is filled with slip which is left to harden for a predetermined amount of time. After a predetermined amount of time has elapsed, the unhardened slip is poured out of the mold components 34, 36 through drain holes (not shown) provided on the bowl 10 and the mold components 34, 36 such that the inner channel 24 in the rim portion 22 and the foot drain cast cavities 26 near the base 12 of the bowl 10 are created. The mold piece 60 (FIG. 4), once it has been removed from the top and bottom mold components 34, 36 after sufficient hardening, will be substantially similar in shape to the bowl 10 except for the plurality of cavities 32 that have not been created yet. The plurality of cavities 32 can be formed on the hardened slip through perforating means, such as a pneumatic or hydraulic punching device, and the mold piece 60 is left to dry into a greenware piece. The greenware piece can be glazed or coated and then fired, in a kiln or a furnace, to complete the bowl 10.

Figure 5:
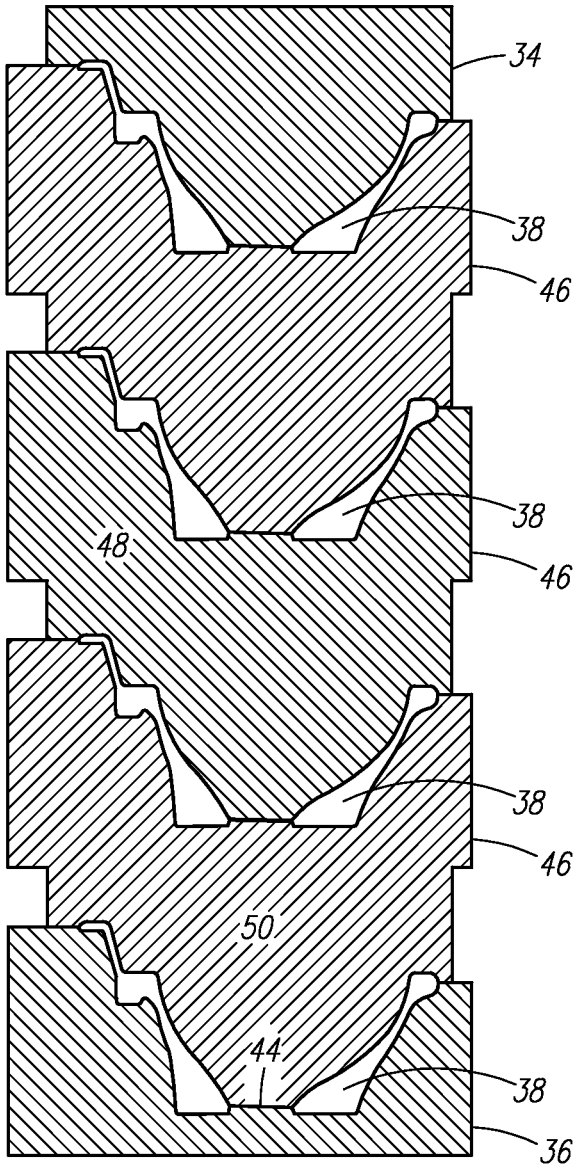
FIG. 5 is a cross-sectional view of mold components stacked in order to mold a plurality of mold pieces for the bowl at the same time.

In this embodiment, the top mold component 34 and the bottom mold component 36 respectively act as a male portion and a female portion of the mold assembly. As shown in FIGS. 4 and 5, the bottom mold component 36 provides as a basin 43 for the slip while a first protrusion 40 of the top mold component 34 projects into the basin 43 occupying the majority of the space in the basin 43. The first protrusion 40 which shapes the interior space 18 of the bowl 10 is configured to contact a second protrusion 42 of the bottom mold component 36 as the top and bottom mold components 34, 36 are assembled, creating a contact surface 44 and thereby forming the bottom opening 16 of the bowl 10. The exterior of the top and bottom mold components of FIGS. 3 and 4 look different but the first and second protrusions 40 and 42 are the same. An extension of the interior space 18 below the contact surface 44 tends to widen and is not considered as part of the interior space 18 of the bowl 10 in this embodiment.

The molding of the bowl 10 is simplified by the shape of the bowl 10 because only the top and bottom mold components 34, 36 are needed to mold the bowl 10 of the present invention. The shape and geometry of the bowl 10 are such that the bowl 10 does not require multiple pieces to be separately molded and secured prior to firing up the bowl 10 because the only greenware piece need to form the bowl 10 is created and substantially shaped in the reservoir 38 of the mold components 34, 36.

There may be variations in the configuration of the interior surface 30 that can still be formed using only the top and bottom mold components 34, 36. For example, the interior surface 30 may be ridged in such a way that the horizontal cross section of the interior space 18 does not widen from the open top 14 toward the bottom opening 16. Such minor variations are believed to be within the scope and spirit of the present invention.

Moreover, multiple bowls 10 can be molded at the same time or simultaneously using mold components 34, 36 that are configured to be stacked or placed on top of one another. As shown in FIG. 5, intermediary mold components 46 may be provided to make such stacking possible. Intermediary mold components 46 include an upper portion 48 that is similar in shape to the bottom mold component 36 and a lower portion 50 similar in shape to the top mold component 34. Alternatively, a component similar to the intermediary mold components 46 may be formed by stacking or gluing a bottom mold component 36 on a top mold component 34.

Although the embodiment of the bowl 10 has features similar to a toilet system, the bowl 10 in accordance with the present invention may be configured to be utilized in any type of application, large or small, in which fluid flow occurs in and about a vessel-like structure, including, but not limited to, a basin, a bath tub, a Jacuzzi, a sink, a bidet, a swimming pool, a fountain or other systems with plumbing.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. A one-piece bowl including:

an interior surface defining an open top, a bottom opening, and an interior space;

a rim portion substantially surrounding the bowl near the open top;

an inner channel formed along and within the rim portion; and a plurality of cavities extending from the inner channel to the interior space, wherein the inner channel and the cavities are configured to operably pass fluid originating from an outer fluid source to the interior space, and wherein an interior surface of the rim portion and the interior surface are integral components that form a continuous and uninterrupted smooth surface defined by an arc of a line such that the interior surface of the rim portion does not project inwardly into the interior space of the bowl.

2. The bowl of claim 1, wherein the interior space extends to the upper edge of the rim portion, and the interior space is widest at the upper edge of the rim portion and narrowest at the bottom opening.

3. The bowl of claim 2, wherein a first horizontal cross section of the interior space at a given height is not larger in area than a second horizontal cross section at a more elevated height.

4. The bowl of claim 3, wherein the interior space is configured to continuously taper from the upper edge of the rim portion to the bottom opening.

5. The bowl of claim 1, wherein the rim portion projects away from the interior space.

6. The bowl of claim 1, wherein the cavities are formed in a substantially radial direction.

7. The bowl of claim 1, wherein the plurality of cavities is oriented at a slight downward angle from the inner channel to the interior space.

8. The bowl of claim 1, wherein a section of the interior surface of the bowl on which the cavities are formed has an angle of inclination that is closer to vertical than horizontal.

9. The bowl of claim 1, wherein the bowl includes a fluid supply hole for introducing fluid into the inner channel.

10. The bowl of claim 1, wherein the bowl includes a base allowing the bowl to stand on its own.

11. The bowl of claim 10, wherein the bowl substantially constitutes a receptacle portion of a toilet system, and the inner channel and the bottom opening are operably connected with a flushing system of the toilet system.

12. A one-piece bowl including:

an interior surface defining an open top, a bottom opening, and an interior space;

a rim portion substantially surrounding the bowl near the open top;

an inner channel formed along and within the rim portion; and a plurality of cavities extending from the inner channel to the interior space, wherein the interior space extends to the upper edge of the rim portion;

wherein the inner channel and the cavities are configured to operably pass fluid originating from an outer fluid source to the interior space, and wherein the rim portion projects away from the interior space such that the rim portion does not extend into the interior space, and the interior surface of the rim portion and the interior surface are integral components that form a continuous smooth surface defined by an arc of a line.

13. A one-piece bowl including:

an interior surface defining an open top, a bottom opening, and an interior space;

a rim portion substantially surrounding the bowl near the open top;

an inner channel formed along and within the rim portion; and a plurality of cavities extending from the inner channel to the interior space, wherein the inner channel and the cavities are configured to operably pass fluid originating from an outer fluid source to the interior space, and wherein an interior surface of the rim portion and the interior surface are integral components that form a continuous smooth surface defined by an arc of a line that is free of substantial protrusions, corners, and edges projecting into the interior space of the bowl.

14. A one-piece bowl including:

an interior surface defining an open top, a bottom opening, and an interior space;

a rim portion substantially surrounding the bowl near the open top;

an inner channel formed along and within the rim portion; and a plurality of cavities extending from the inner channel to the interior space, wherein the inner channel and the cavities are configured to operably pass fluid originating from an outer fluid source to the interior space, wherein an interior surface of the rim portion and the interior surface are integral components that form a continuous and uninterrupted smooth surface defined by an arc of a line; and wherein a section of the interior surface of the bowl on which the cavities are formed has an angle of inclination that is significantly closer to vertical than horizontal.

15. A one-piece bowl including:

an interior surface defining an open top, a bottom opening, and an interior space;

a rim portion substantially surrounding the bowl near the open top;

an inner channel formed along and within the rim portion;

a plurality of cavities extending from the inner channel to the interior space; and wherein an interior surface of the rim portion and the interior surface are integral components forming a continuous surface that is defined by an arc of a line extending from an upper edge of the rim portion to the bottom opening, wherein the line does not form an acute angle, and wherein the inner channel and the cavities are configured to operably pass fluid originating from an outer fluid source to the interior space.

* * * * *